US009587401B1

(12) United States Patent
Benton

(10) Patent No.: US 9,587,401 B1
(45) Date of Patent: Mar. 7, 2017

(54) BAR JOIST REINFORCEMENT APPARATUS

(71) Applicant: Jason Rickman Benton, Tallassee, AL (US)

(72) Inventor: Jason Rickman Benton, Tallassee, AL (US)

( * ) Notice: Subject to any disclaimer, the term of this patent is extended or adjusted under 35 U.S.C. 154(b) by 0 days.

(21) Appl. No.: 15/160,134

(22) Filed: May 20, 2016

(51) Int. Cl.

| | |
|---|---|
| ***E04C 3/02*** | (2006.01) |
| ***E04C 3/08*** | (2006.01) |
| ***E04C 3/32*** | (2006.01) |
| ***E04C 3/16*** | (2006.01) |
| ***E04C 3/04*** | (2006.01) |

(52) U.S. Cl.
CPC ..... *E04C 3/02* (2013.01); *E04C 3/04* (2013.01); *E04C 3/08* (2013.01); *E04C 3/16* (2013.01); *E04C 3/32* (2013.01); *E04C 2003/026* (2013.01)

(58) Field of Classification Search
CPC ..... E04C 3/02; E04C 3/08; E04C 3/32; E04C 3/16; E04C 3/04; E04G 25/06; E04G 25/08; E04G 11/46; B66F 3/08
USPC .... 52/127.2, 291, 749.1, DIG. 1; 248/125.8, 248/200.1, 214, 217.2, 354.1, 354.3, 248/354.4, 357
See application file for complete search history.

(56) References Cited

U.S. PATENT DOCUMENTS 4,304,078 A * 12/1981 Meriwether, Jr. ... E04F 21/0015 248/354.3
4,340,196 A * 7/1982 Eldred ..... B64F 5/00 16/49
4,518,141 A * 5/1985 Parkin ..... F21V 21/03 248/217.2
5,313,749 A 5/1994 Conner
6,243,996 B1 6/2001 Oliver et al.
6,655,097 B1 * 12/2003 Poolaw ..... E04H 12/20 248/188.1
7,305,802 B1 * 12/2007 Plavidal ..... E04G 23/02 52/223.14
7,673,427 B2 3/2010 Morey
7,703,244 B2 4/2010 Suzuki et al.
7,735,268 B1 * 6/2010 Zidar ..... E04G 23/0218 248/300
7,748,180 B1 7/2010 Plavidal
9,151,034 B2 10/2015 Jaeschke
2003/0131543 A1 * 7/2003 Hansort ..... E04G 21/26 52/127.2
2012/0180407 A1 7/2012 Rees et al.

* cited by examiner

*Primary Examiner* — Brian Glessner
*Assistant Examiner* — Adam Barlow
(74) *Attorney, Agent, or Firm* — Waller Lansden Dortch & Davis, LLP; Larry W. Brantley

(57) ABSTRACT

A bar joist reinforcement apparatus may include a base assembly adapted to be connected to a lower portion of a bar joist, a top assembly adapted to be connected to a top portion of the bar joist, and an adjustable coupling assembly connected between the base assembly and the top assembly for adjusting the distance separating the base and top assemblies. The apparatus may be used to reinforce a bar joist by inserting the apparatus in between upper and lower portions of a bar joist, adjusting the apparatus so the top and base assemblies come into contact with, press against, and/or brace the upper and lower portions of the bar joist, and connecting the apparatus to the bar joist using bolts and conventional tools instead of welding.

19 Claims, 7 Drawing Sheets

SECTION A-A

DETAIL F

SECTION G-G

DETAIL J

SECTION K-K

BAR JOIST REINFORCEMENT APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to bar joists.

More particularly, the present disclosure relates to an apparatus for reinforcing bar joists.

Bar joists are well known in the prior art. These devices are used in the construction of buildings and other structures and are usually designed to support specific loads. Sometimes, however, buildings are modified after construction in a way that increases the loads on these bar joists and this creates a problem that needs to be addressed.

For example, in some cases, bar joists are used to support a portion of a building roof that is, in turn, supporting a heating, ventilation and air conditioning unit (commonly referred to as a HVAC unit) that has a specific weight. Over time, the HVAC unit wears out and fails, and must be replaced with a new HVAC, which, in many cases, weighs more than the original unit. In other situations, the building owners simply want to add some type of additional feature, like solar panels for example, to the roof of an existing building or hanging fixtures, e.g. lighting displays, signage, or mechanical equipment, beneath an existing bar joist, and this likewise increases the loads on bar joists in the building.

Regardless of the reason, the typical prior art solution to this problem is to reinforce the affected bar joists by welding supports or braces, like gussets, for example, to the bar joists. This solution, however, has several disadvantages.

Welding these supports into place can overheat and weaken the structural integrity of the bar joists. Supports have to be properly fitted to the bar joists and this may involve several trips between the equipment being used to create the support and the bar joists. Specialized tools, e.g. welding equipment and masks, and certified welders have to be used to perform the welding. Because of the risk of fire created by sparks, fire protection measures, e.g., weld blankets and additional safety staff, have to be employed during the welding process. Finally, welds have to be inspected after the welding process to ensure that supports have been properly welded to the bar joists.

Thus, what is needed then, is a way to reinforce bar joists that does not suffer from the disadvantages of this prior art method of reinforcing bar joists.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention is directed to an apparatus for reinforcing bar joists that overcomes the disadvantages of the prior art. The apparatus does not require welding the bar joists, specialized equipment, certified welders, fire protection methods, or weld inspections. It can also be easily fitted to bar joists and does not require multiple trips to ensure a proper fit to the bar joists. In one embodiment, the apparatus may include a base assembly adapted to be connected to a lower portion of a bar joist, a top assembly adapted to be connected to a top portion of the bar joist, and an adjustable coupling assembly connected between the base assembly and the top assembly for adjusting the distance separating the base and top assemblies. The apparatus may be used to reinforce a bar joist by inserting the apparatus between an upper and lower portion of the bar joist, adjusting the coupling assembly so that the base and top assemblies come into contact with, press against, and/or brace the lower and upper portions of the bar joist, and connecting the apparatus to the upper and lower portions of the bar joist using bolts and conventional tools.

Numerous other objects, advantages and features of the present disclosure will be readily apparent to those of skill in the art upon a review of the following drawings and description of a preferred embodiment.

DETAILED DESCRIPTION

Figure 1:
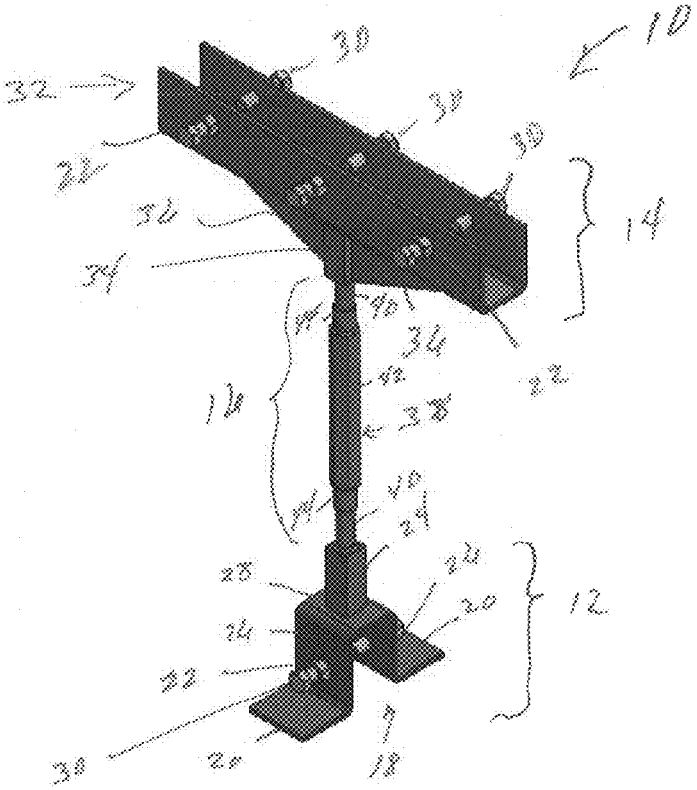
FIG. 1 is a perspective view showing one embodiment of the present invention.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

An exemplary embodiment of the apparatus 10 of the present invention is shown in FIG. 1. The apparatus 10 may be used to reinforce a bar joist and may include a base assembly 12, a top assembly 14, and an adjustable coupling assembly 16 connected between the base and top assemblies for moving the base and top assemblies back and forth with respect to one another. The base assembly 12 may include an inverted u-shaped portion 18 having two substantially flat flanges 20 extending perpendicularly outward therefrom, a pair of nuts 22 connected to side outer surfaces of the inverted u-shaped portion 18, and an elongated rectangular portion 24 extending perpendicularly outward from an upper outer surface of the inverted u-shaped portion 18. The inverted u-shaped portion 18 may include a pair of substantially flat arms 26 perpendicularly connected to a substantially flat top portion 28. The substantially flat flanges 20 may extend perpendicularly outward from one end of the substantially flat arms 26. The inverted u-shaped portion 18 may further include a pair of bolt openings (not shown) defined in the center portions of the arms 26 and the pair of nuts 22 may be connected to the center portion of the arms 26 adjacent to the pair of bolt openings.

The elongated rectangular portion 24 may be connected to and extend perpendicularly outward from the upper outer surface of the inverted u-shaped portion 18 and may include female threads (not shown) defined in the end of the portion 24 opposite from the end connected to the inverted u-shaped portion 18. The flanges 20 may have a length that is less than the length of the arms 26. Nuts 22 and rectangular portion 24 may be welded to the inverted u-shaped portion 18. Bolts 30 may be used to connect the apparatus 10 to the lower portion of a bar joist as described in more detail below. The number of nuts 22, bolts 30, and bolt openings may vary from one embodiment to another, e.g., other embodiments may include 2, 3, or more bolts, nuts, and bolt openings.

The top assembly 14 may include a u-shaped elongated portion 32, an elongated rectangular portion 34 connected to, and extending perpendicularly outward from, a lower portion thereof, additional nuts 22 connected (in some embodiments, by welding) to outer surfaces of elongated portion 32 adjacent to a plurality of bolt openings (not shown) defined in the elongated portion 32, and a pair of gussets 36 connected to the u-shaped portion 32 and the rectangular portion 34 extending therefrom. Gussets 36 may be welded to the lower portion of the u-shaped elongated portion 32 and the rectangular portion 34. Rectangular portion 34 may likewise be welded to the lower portion of the u-shaped elongated portion 32 and may include female threads (not shown) defined in the end of the portion 34 opposite from the end connected to the u-shaped elongated portion 32.

The adjustable coupling assembly 16 may include a turnbuckle 38 and a pair of male threaded rods 40. Turnbuckle 38 may include a hexagonal portion 42 and cylindrical end portions 44. Female threads (not shown) may be defined in the end portions 44 of the turnbuckle 38. Rods 40 may be connected to rectangular portions 24 and 34, and the turnbuckle 38, using the male and female threads defined in these members. The base assembly 12 and the top assembly 14 may be made out of 10 gauge steel.

Figure 2:
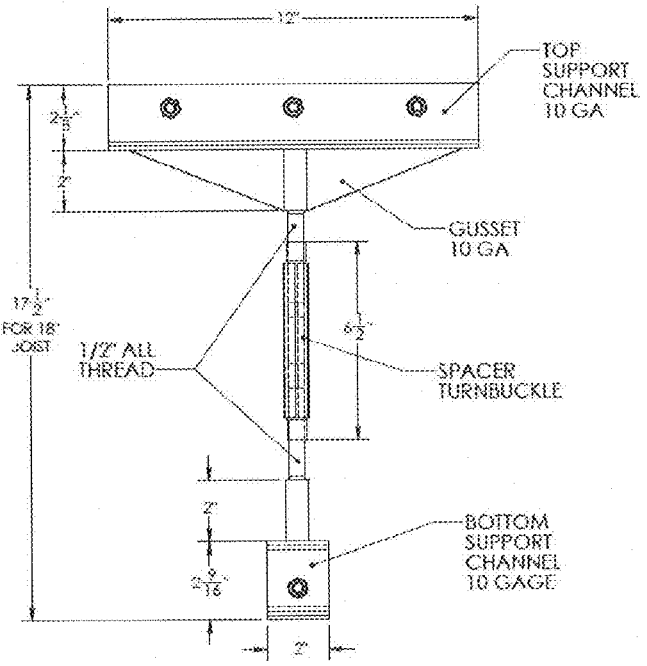
FIG. 2 is a side view of the embodiment of the present invention shown in FIG. 1.
Figure 3:
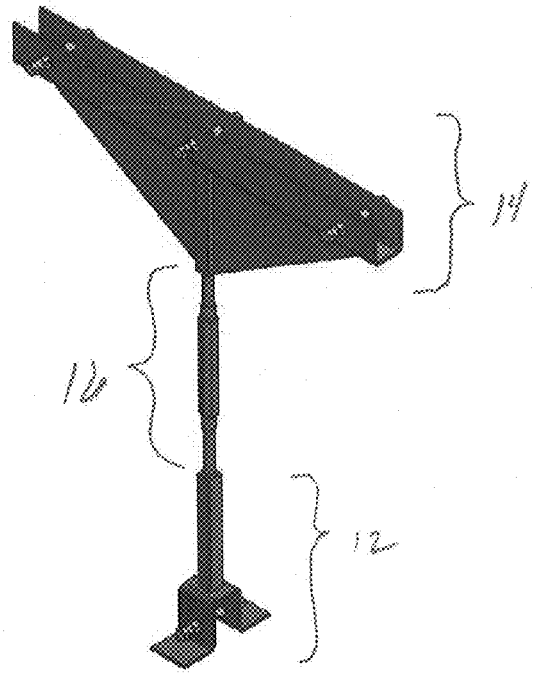
FIG. 3 is a perspective view of another embodiment of the present invention.
Figure 4:
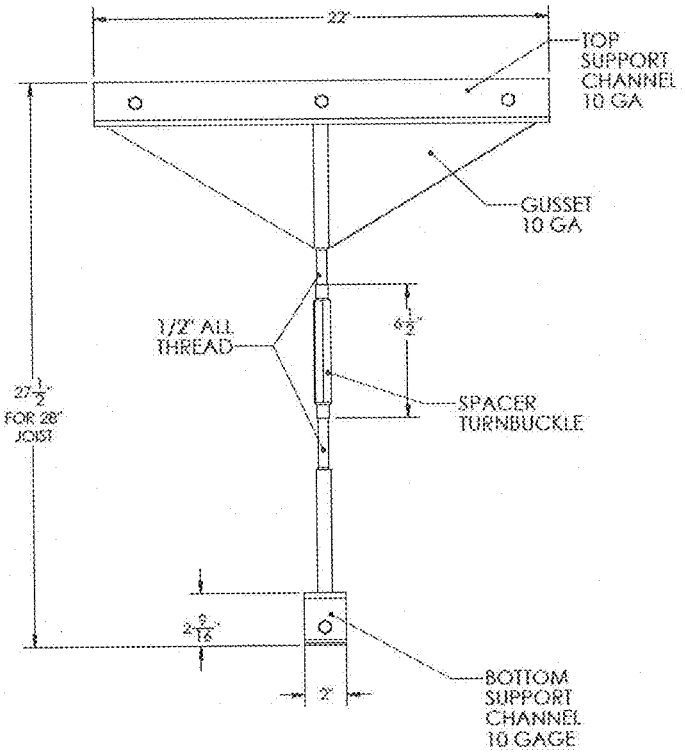
FIG. 4 is a side view of the embodiment of the present invention shown in FIG. 3.

The size of the apparatus 10 may vary for different size bar joists. For example, for an 18 inch bar joist (FIGS. 1 and 2), the inverted u-shaped portion 18 may be 2 inches wide and have a height of 2 9/16 inches, the rectangular portions 24 and 34 may each have a length of 2 inches, the u-shaped portion 32 may have a length of 12 inches and a height of 2⅛ inches, all of the threads may be ½ inch threads, the turnbuckle 38 may have a length of 6½ inches, and the minimum distance from the top of the u-shaped portion 32 to the bottom of the inverted u-shaped portion 18 may be 17½ inches. For a 28 inch bar joist (FIGS. 3 and 4), the u-shaped portion 32 may have a length of 22 inches, the rectangular portions 24 and 34 each may have a length of 7 inches, and the minimum distance from the top of the u-shaped portion 32 to the bottom of the inverted u-shaped portion 18 may be 27½ inches.

Figure 5:
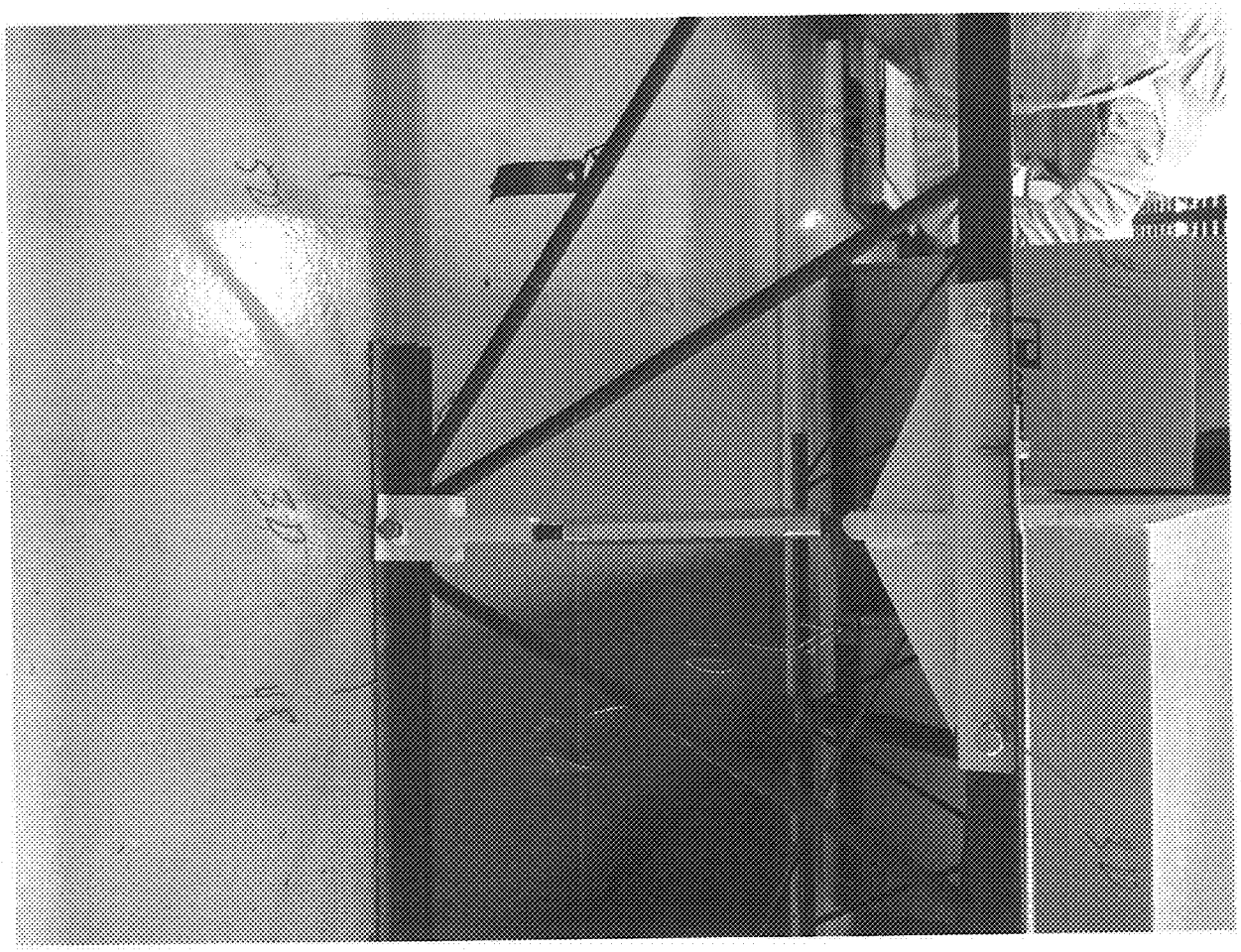
FIG. 5 is a side view of yet another embodiment of the present invention.
Figure 6:
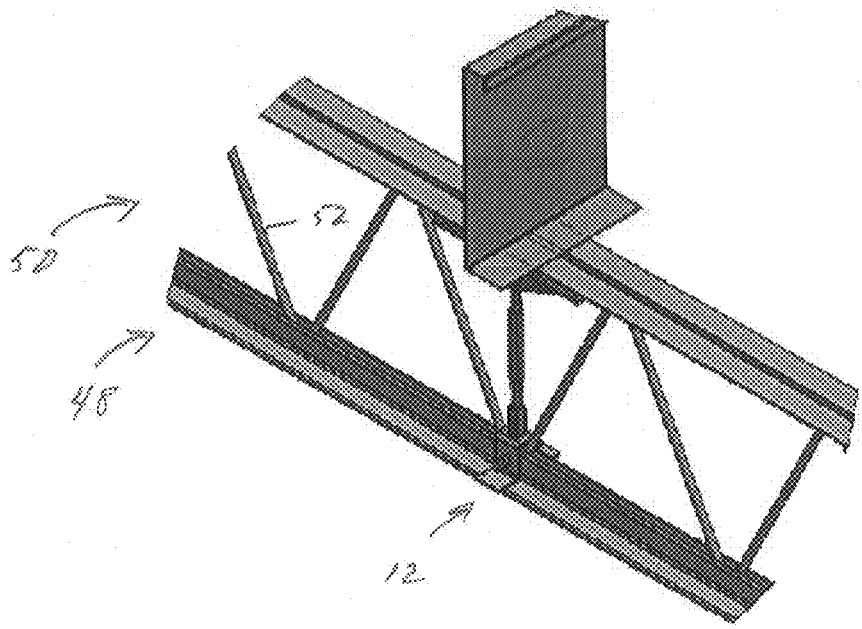
FIG. 6 is a perspective view of the embodiment of the present invention shown in FIG. 1 installed on a bar joist.
Figure 7:
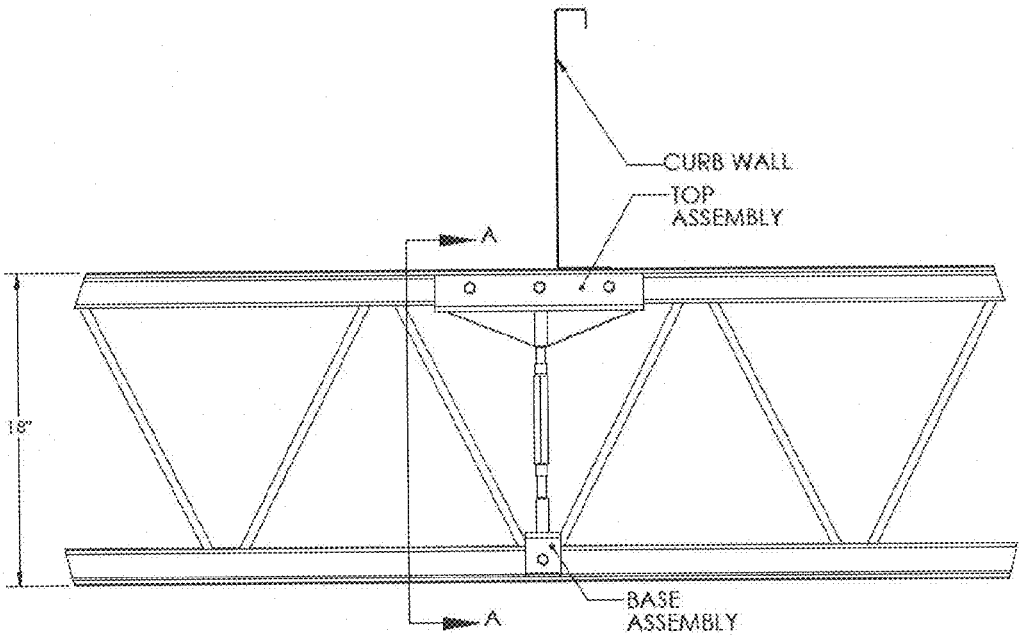
FIG. 7 is a side view of the embodiment of the present invention shown in FIG. 6.
Figure 8:
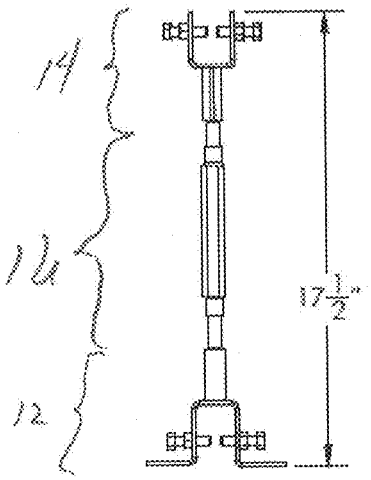
FIG. 8 is an enlarged detail view along section A-A shown in FIG. 7.
Figure 9:
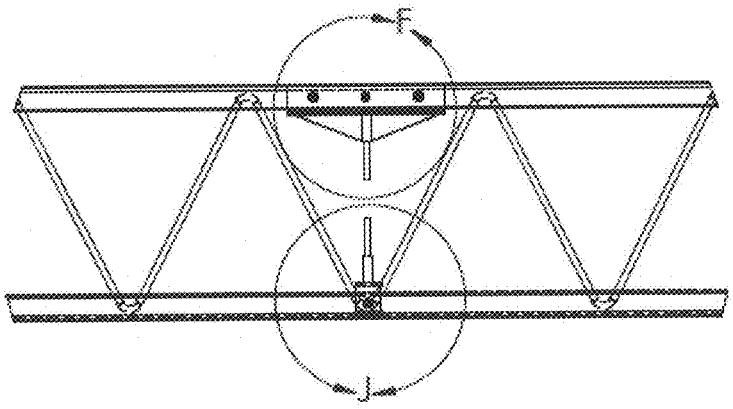
FIG. 9 is a partial side view of an embodiment of the present invention shown installed on a bar joist.
Figure 10:
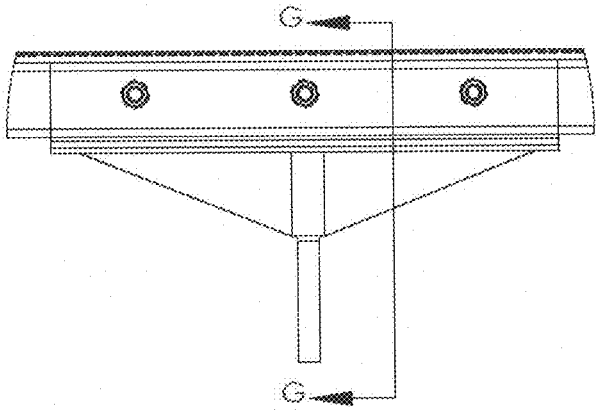
FIG. 10 is an enlarged detail view showing detail F from FIG. 9.
Figure 11:
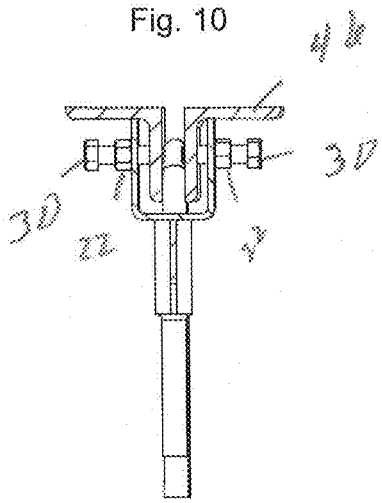
FIG. 11 is an enlarged detail view along section G-G shown in FIG. 10.
Figure 12:
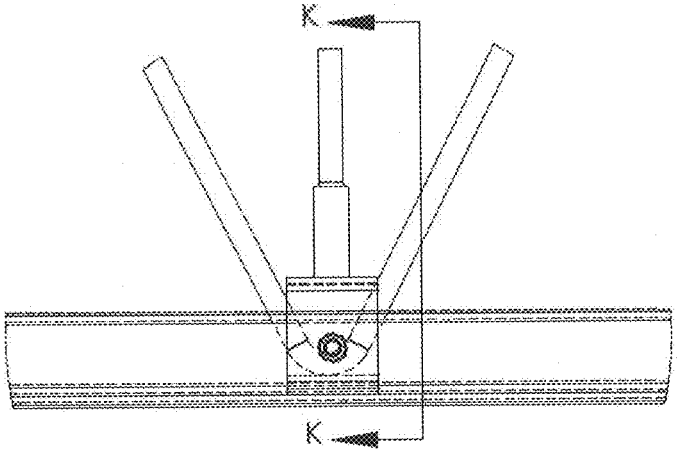
FIG. 12 is an enlarged detail view showing detail J from FIG. 9.
Figure 13:
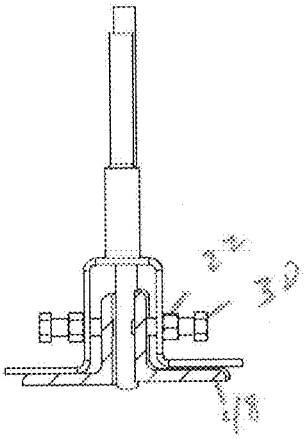
FIG. 13 is an enlarged detail view showing section K-K from FIG. 12.

Referring to FIG. 5, the apparatus 10 may be designed so that it can be inserted in between an upper portion 46 and a lower portion 48 of a bar joist 50 having support arms 52. In practice, the turnbuckle 38 may be adjusted to minimize the distance between the top and base assemblies so the apparatus 10 can be inserted in between the upper and lower portions of the bar joist 50 and then adjusted again to expand the top and base assemblies with respect to one another until they come into contact with, press against, and/or brace the upper and lower portions of the bar joist 50. In some embodiments, the top and base assemblies may just come into contact with the upper and lower portions of the bar joist 50 and may not press against or brace the upper and lower portions until they deform slightly under a load. The apparatus 10 can then be further secured into place by connecting the u-shaped portion 34 and inverted u-shaped portion 18 to the upper and lower portions of the bar joist 50 using one or more bolts 30. The apparatus 10 may be positioned so that the inverted u-shaped portion 18 connects to the lower portion of the bar joist 50 where two support arms 52 meet and the u-shaped portion 34 connects to the upper portion of the bar joist 50 in between two support arms 52. The apparatus 10 may include a curb wall 56, which may be connected, using a bolt 30, to the upper portion of the bar joist 50 adjacent to the u-shaped portion 34. As shown in FIGS. 11 and 13, bolts 30 may pass through bolts 22, adjacent bolt openings, and into contact with the upper portion 46 and lower portion 48 of the bar joist 50 when the apparatus 10 is secured to the bar joist 50.

Thus, although there have been described particular embodiments of the present invention of a new and useful BAR JOIST REINFORCEMENT APPARATUS, it is not intended that such references be construed as limitations upon the scope of this invention.

What is claimed is:

1. An apparatus, comprising:

a base assembly including an inverted u-shaped portion and two substantially flat flanges extending perpendicularly outward therefrom, a plurality of base bolt openings defined in the inverted u-shaped portion, a plurality of base nuts connected to outer surfaces of the inverted u-shaped portion adjacent to the plurality of base bolt openings, and a base elongated rectangular portion extending perpendicularly outward from the inverted u-shaped portion;

a top assembly including an elongated u-shaped portion, a plurality of top bolt openings defined in the elongated u-shaped portion, and a plurality of top nuts connected to outer surfaces of the elongated u-shaped portion adjacent to the plurality of top bolt openings, wherein the top assembly includes a top elongated rectangular portion extending perpendicularly outward from the elongated u-shaped portion and a plurality of gussets connected to opposite sides of the top elongated rectangular portion and the elongated u-shaped portion; and an adjustable coupling assembly connected between the base assembly and the top assembly;

wherein, when the adjustable coupling assembly is rotated in one direction, the base assembly and top assembly move away from one another and, when the adjustable coupling assembly is rotated in an opposite direction, the base assembly and top assembly move toward one another.

2. The apparatus of claim 1, wherein:

the inverted u-shaped portion of the base assembly includes a substantially flat center portion and two substantially flat arms extending perpendicularly therefrom;

the two substantially flat flanges extend perpendicularly outward from the two substantially flat arms; and the two substantially flat flanges are shorter than the two substantially flat arms.

3. The apparatus of claim 2, wherein the adjustable coupling assembly includes a turnbuckle adjustably connected to a pair of rods and the rods are connected to the base and top assemblies.

4. The apparatus of claim 3, wherein the turnbuckle is hexagonally shaped with cylindrical end portions.

5. The apparatus of claim 4, wherein:

the cylindrical end portions of the turnbuckle are hollow and include female threads defined in an inner surface therein;

each rod includes at least one end having male threads defined thereon; and the turnbuckle is adjustably connected to the rods using the male threads defined on the rods and the female threads defined in the turnbuckle.

6. The apparatus of claim 5, wherein:

the base and top assemblies include female threads defined therein;

each rod includes male threads defined on both ends; and the rods are connected to the base and top assemblies using the male threads defined on the rods and the female threads defined in the base and top assemblies.

7. An apparatus, comprising:

a base assembly including an inverted u-shaped portion, a plurality of base bolt openings defined in the inverted u-shaped portion, and a plurality of base nuts connected to outer surfaces of the inverted u-shaped portion adjacent to the plurality of base bolt openings;

a top assembly including an elongated u-shaped portion, a plurality of top bolt openings defined in the elongated u-shaped portion, a plurality of top nuts connected to outer surfaces of the elongated u-shaped portion adjacent to the plurality of top bolt openings, a top elongated rectangular portion extending perpendicularly outward from the elongated u-shaped portion, and a plurality of gussets connected to the elongated u-shaped portion and opposite sides of the top elongated rectangular portion; and an adjustable coupling assembly connected between the base assembly and the top assembly;

wherein, when the adjustable coupling assembly is rotated in one direction, the base assembly and top assembly move away from one another and, when the adjustable coupling assembly is rotated in an opposite direction, the base assembly and top assembly move toward one another.

8. The apparatus of claim 7, wherein:

the inverted u-shaped portion of the base assembly includes a substantially flat center portion, two substantially flat arms extending perpendicularly therefrom, and two substantially flat flanges extending perpendicularly outward from the two substantially flat arms;

the substantially flat center portion is parallel to the two substantially flat flanges; and the two substantially flat flanges are shorter than the two substantially flat arms.

9. The apparatus of claim 8, wherein the adjustable coupling assembly includes a turnbuckle adjustably connected to a pair of rods and the rods are connected to the base and top assemblies.

10. The apparatus of claim 9, wherein the turnbuckle is hexagonally shaped with cylindrical end portions.

11. The apparatus of claim 10, wherein:

the cylindrical end portions of the turnbuckle are hollow and include female threads defined in an inner surface therein;

each rod includes at least one end having male threads defined thereon; and the turnbuckle is adjustably connected to the rods using the male threads defined on the rods and the female threads defined in the turnbuckle.

12. An apparatus, comprising:

a base assembly including an inverted u-shaped portion and a base elongated rectangular portion extending perpendicularly outward from the inverted u-shaped portion;

a top assembly including an elongated u-shaped portion, a top elongated rectangular portion extending perpendicularly outward from the elongated u-shaped portion, and a plurality of gussets connected to the elongated u-shaped portion and opposite sides of the top elongated rectangular portion; and an adjustable coupling assembly connected between the base assembly and the top assembly, the adjustable coupling assembly including a pair of rods connected to the base and top assemblies and a turnbuckle adjustably connected to the pair of rods;

wherein, when the turnbuckle is rotated in one direction, the base assembly and top assembly move away from one another and, when the turnbuckle is rotated in an opposite direction, the base assembly and top assembly move toward one another.

13. The apparatus of claim 12, wherein the turnbuckle is hexagonally shaped with cylindrical end portions.

14. The apparatus of claim 13, wherein:

the cylindrical end portions of the turnbuckle are hollow and include female threads defined in therein;

each rod includes at least one end having male threads defined thereon; and the turnbuckle is adjustably connected to the rods using the male threads defined on the rods and the female threads defined in the turnbuckle.

15. The apparatus of claim 14, wherein:

the base and top elongated rectangular portions include female threads defined therein;

each rod includes male threads defined on both ends; and the rods are connected to the base and top assemblies using the male threads defined on the rods and the female threads defined in the base and top elongated rectangular portions.

16. The apparatus of claim 15, wherein:

the inverted u-shaped portion of the base assembly includes a substantially flat center portion, two substantially flat arms extending perpendicularly therefrom, and two substantially flat flanges extending perpendicularly outward from the two substantially flat arms;

the substantially flat center portion is parallel to the two substantially flat flanges; and the two substantially flat flanges are shorter than the two substantially flat arms.

17. The apparatus of claim 16, wherein the base assembly further includes a plurality of base bolt openings defined in the inverted u-shaped portion and a plurality of base nuts connected to outer surfaces of the inverted u-shaped portion adjacent to the plurality of base bolt openings.

18. The apparatus of claim 17, wherein the top assembly further includes a plurality of top bolt openings defined in the elongated u-shaped portion and a plurality of top nuts connected to outer surfaces of the elongated u-shaped portion adjacent to the plurality of top bolt openings.

19. The apparatus of claim 18, wherein:

the base elongated rectangular portion and the plurality of base nuts are welded to the inverted u-shaped portion;

the top elongated rectangular portion, the plurality of gussets, and the plurality of top nuts are welded to the elongated u-shaped portion; and the plurality of gussets are welded to the top elongated rectangular portion.

* * * * *